United States Patent [19]

Gilbert

[11] Patent Number: 4,475,169

[45] Date of Patent: Oct. 2, 1984

[54] HIGH-ACCURACY SINE-FUNCTION GENERATOR

[75] Inventor: Barrie Gilbert, Forest Grove, Oreg.

[73] Assignee: Analog Devices, Inc., Norwood, Mass.

[21] Appl. No.: 344,543

[22] Filed: Feb. 1, 1982

[51] Int. Cl.[3] ..... G06G 7/22

[52] U.S. Cl. ..... 364/817; 307/498; 364/851

[58] Field of Search ..... 364/815, 816, 817, 818, 364/850, 603, 607, 608, 851, 856; 307/490, 498, 260; 328/142, 161, 14; 340/347 SY

[56] References Cited

U.S. PATENT DOCUMENTS

| | | | |
|---|---|---|---|
| 3,868,680 | 2/1975 | Rhodes | 364/603 X |
| 3,984,672 | 10/1976 | Jones | 364/603 X |
| 4,164,729 | 8/1979 | Simon et al. | 340/347 SY |

OTHER PUBLICATIONS

Gilbert, "Monolithic Analog Read-only Memory for Character Generation" IEEE JSSC, vol. SC-6, No. 1, Feb. 1971.

*Primary Examiner*—Joseph F. Ruggiero
*Attorney, Agent, or Firm*—Parmelee, Bollinger & Bramblett

[57] ABSTRACT

A sine-function generator comprising a plurality of bipolar transistors with their collectors connected to a pair of output terminals in alternating antiphase and their emitters connected in common to a single current source. The bases of the transistors are connected to respective nodal points of a base-bias network comprising a series-connected string of equal resistors. Current sources supply equal currents to the network nodal points to develop base voltages at those points according to a predetermined distribution pattern establishing a peak voltage along a line representing the nodal sequence. An input signal applied to the ends of the resistor string controls the location of this voltage peak along the nodal line, thereby controlling the current flow through the transistors in such a way that the net differential output current is proportional to the sine of the angle represented by the input signal. A ladder-type base-bias network also is disclosed.

20 Claims, 9 Drawing Figures

THE OUTPUT FUNCTION

+Vs
-Vs

USUAL CONNECTION
OUTPUT AMPLIFIER
Vo
RF
CURRENT SOURCES
15K
Q
2K
150μA
300μA
TYPICALLY 1.15V
R
500
Q1
Q2
Q3
Q4
Q5
Q6
Q57
Q77
Q58
3K
12K
24K
DRIVE CURRENT
IE
θ1
θ2
CONTROL BIAS
V REF. (+1.8V)
650μA NORMAL

FUNCTION & ERROR FOR ONE CONFIGURATION

ALTERNATIVE BASE-NETWORK

DRIVER STAGE FOR THE ALTERNATIVE BASE NETWORK

ELEVEN-TRANSISTOR SINE-SHAPER USING ALTERNATIVE BASE-NETWORK

HIGH-ACCURACY SINE-FUNCTION GENERATOR

BACKGROUND OF THE INVENTION

1. Field of the Invention

This invention relates to sine-function generators. More particularly, this invention relates to such generators producing an output signal having a precise sinusoidal relationship to analog input signals representing an input angle, and operable over a very large angular range, e.g. ±360°.

2. Description of the Prior Art

Many techniques have been used heretofore to generate an analog output signal having a sinusoidal relationship to an input signal representing an angle. Such prior techniques include piecewise linear approximations, polynomial and other continuous function techniques using multipliers, special translinear circuits, simple modifications of bipolar-transistor differential amplifiers, and circuits comprising large numbers of such differential amplifier stages connected in periodic antiphase.

With the exception of the last-mentioned, all of these approaches suffer from two limitations; first, they generally provide operation only over the angular range of ±90° (some offer ±180° range); second, they are usually of poor accuracy. The last-mentioned approach, as described by the present inventor in "Circuits for the Precise Synthesis of the Sine Function", in Electronic Letters, Vol. 13, Aug. 18, 1977, pp. 506, avoids these two limitations, but with a somewhat complex circuit. The present invention provides significantly greater simplicity and assured high performance in a practical commercial instrument.

SUMMARY OF THE INVENTION

In one preferred embodiment of the invention, to be described hereinafter in detail, there is provided a sine-function generator having a plurality of transistors with their collectors connected to a pair of output terminals in alternating antiphase and their emitters connected in common to a single current source. The bases of the transistors are connected to respective nodal points of a base-bias network. This network is supplied by currents which develop voltages at the nodal points in accordance with a predetermined distribution pattern establishing a peak voltage at some point along a "line" (figuratively speaking) representing the nodal sequence. An input signal applied to the network controls the location of this voltage peak along the nodal line, thereby controlling the current flow through the transistors in such a way that the output current is proportional to the sine of the angle represented by the input signal.

Accordingly, it is an object of the invention to provide an improved sine-function generator capable of accurate operation over a wide angular range. It is a particular object of the invention to provide such apparatus which is simple in design and readily fabricated. Other objects, aspects and advantages of the invention will in part be pointed out in, and in part apparent from, the following detailed description considered together with the accompanying drawings.

DESCRIPTION OF PREFERRED EMBODIMENTS

Referring now to the lower portion of FIG. 1, there is shown a six-transistor circuit Q1–Q6 which forms the core of a sine-function generator to be described in more detail hereinbelow. The collectors are connected in alternating antiphase to a pair of output terminals 12, 14, and a single emitter supply current $I_E$ is divided into the six transistors. The alternating collector connections recombine the individual transistor currents into a differential pair of currents $I_1$ and $I_2$, the sum of which always is $I_E$.

The difference between $I_1$ and $I_2$ is the output current of the circuit $I_o$. The magnitude of this differential current will be determined by the pattern of voltages $V_1$–$V_6$ on the bases of the transistors Q1–Q6. In analyzing this relationship, consider that the voltages become increasingly negative at the outer edges of the circuit. A relatively small bias, e.g. a few hundred millivolts, would completely cut off conduction in the outer transistors.

Taking first the case where $V_3=V_4$ and all the other bases are biased down to, say, −100 mV, essentially all of $I_E$ will split equally between Q3 and Q4; any remaining current will split symmetrically between the outer pairs. Thus the differential output current $I_o$ will be zero. Now if $V_4$ is raised slightly, and $V_3$ lowered the same amount, $I_2$ will increase while $I_1$ will decrease, producing a net output current $I_o$. If the other base voltages are moved in a similar fashion, with increases shifting to the right-of-center of the transistor group, eventually $V_5$ will be sufficiently positive to cause conduction in Q5, thereby increasing $I_1$, lowering $I_2$, and reducing $I_o$ from a maximum value. As $V_5$ approaches $V_4$, the differential current $I_o$ returns towards zero. Still further, $I_o$ passes through zero and increases to another maximum (but with opposite sign). Thereafter, $I_o$ decreases essentially to zero when $V_6=V_5$ and all the other bases are biased negatively.

In accordance with a principal aspect of the present invention, it has been found that such changes in transistor base voltage pattern can be controlled by an angle input signal in such a manner that the differential output current $I_o$ will correspond essentially identically to the sine of the input angle. In an embodiment to be described, a base-biasing network establishes an initial voltage distribution for the transistor bases having a symmetrically located peak, that is, wherein the peak is centered on the "line" (figuratively speaking) of the transistor bases, half-way between the bases of Q3 and Q4. Advantageously, this voltage distribution is parabolic. An input signal is applied to the network to alter the voltage distribution in such a way that the peak is moved linearly along the base "line" in accordance with the magnitude of the input signal, resulting in the generation of the sine function in the output current $I_o$.

Figure 2:
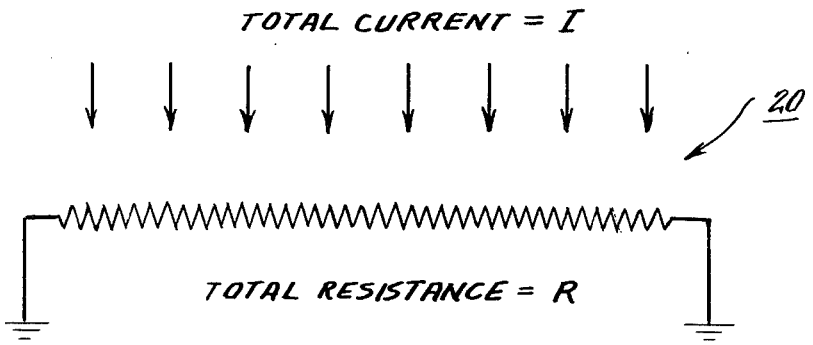
FIG. 2 is a diagrammatic representation of a base-bias network comprising a continuous resistance receiving along its length a distributed current flowing to the end points of the resistance to develop a parabolic voltage distribution along the resistance.

There are various ways of developing a parabolic voltage distribution for the base voltages $V_1$-$V_6$. As shown in FIG. 2, a parabolic distribution could be achieved by a continuous resistance 20, i.e. a long "bar" of resistive material having a total resistance R, receiving along its length a uniformly distributed current with a total value of I flowing symmetrically through the resistance and out the end points. It can be shown that with the given boundary conditions, the voltage along such a bar is parabolic in form and has a peak value of IR/8.

Figure 3:
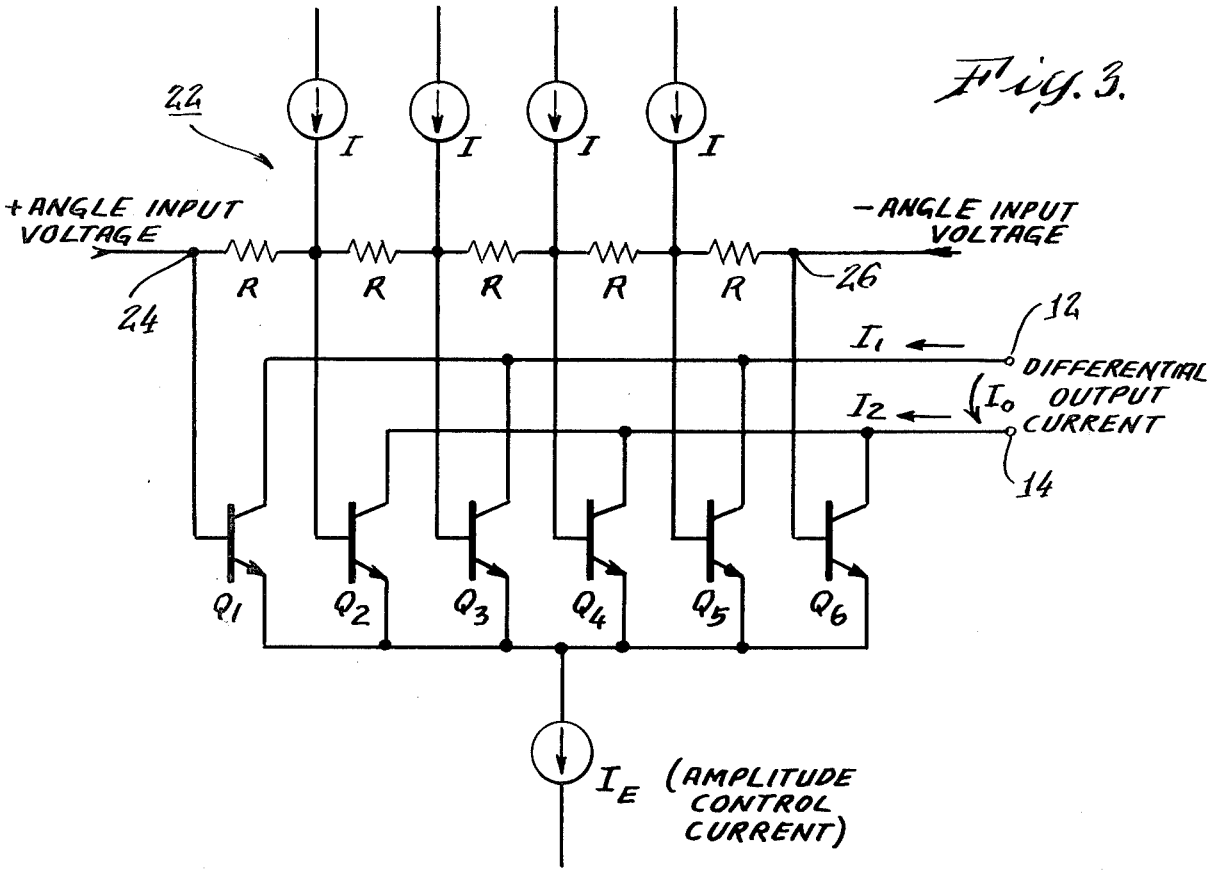
FIG. 3 is one preferred embodiment of a practical base-bias network for developing a parabolic voltage distribution and comprising a series-connected set of resistors receiving equal currents at their nodal points, to which the transistor bases also are connected.

Examples of discrete networks for producing a parabolic voltage distribution are described in the article "Monolithic Analog READ-ONLY Memory for Character Generation" by the present inventor, published in the IEEE Journal of Solid-State Circuits, Vol. SC-6, No. 1, February 1971. FIG. 3 of this application shows one such discrete network 22 connected to the six-transistor circuit of FIG. 1. This network includes five resistors of value R connected between the transistor bases, with four current sources of magnitude I driving the network nodal points between the resistors.

If the outer ends of the base-biasing network are at ground potential, the six nodal voltages are 0, 2IR, 3IR, 3IR, 2IR and 0, respectively. This distribution is shown on the graph of FIG. 1, at the intersections between the curve identified as $\theta=0$ and the vertical lines 1 through 6. These vertical graph lines correspond to the voltages $V_1$-$V_6$ at the transistor base terminals directly beneath those vertical lines. For this symmetrical parabolic distribution for $\theta=0$, it will be evident that $I_1=I_2$, so that $I_o=0$.

The angle input signal is applied differentially as a voltage between the ends 24, 26 of the base-bias network 22. For an angle input corresponding to 90°, the voltage distribution pattern will follow the curve identified on the graph as $\theta=90°$. It will be seen that the peak voltage of the parabola occurs at vertical line 4. Thus Q4 conducts heavily while very little current passes through the remaining transistors, producing a large net differential output current $I_o$. For an angle input of $\theta=180°$, the voltages on $V_4$ and $V_5$ are equal (see vertical lines 4 and 5 on the graph), and Q4 and Q5 conduct equally so that $I_o$ approaches zero.

Figure 1:
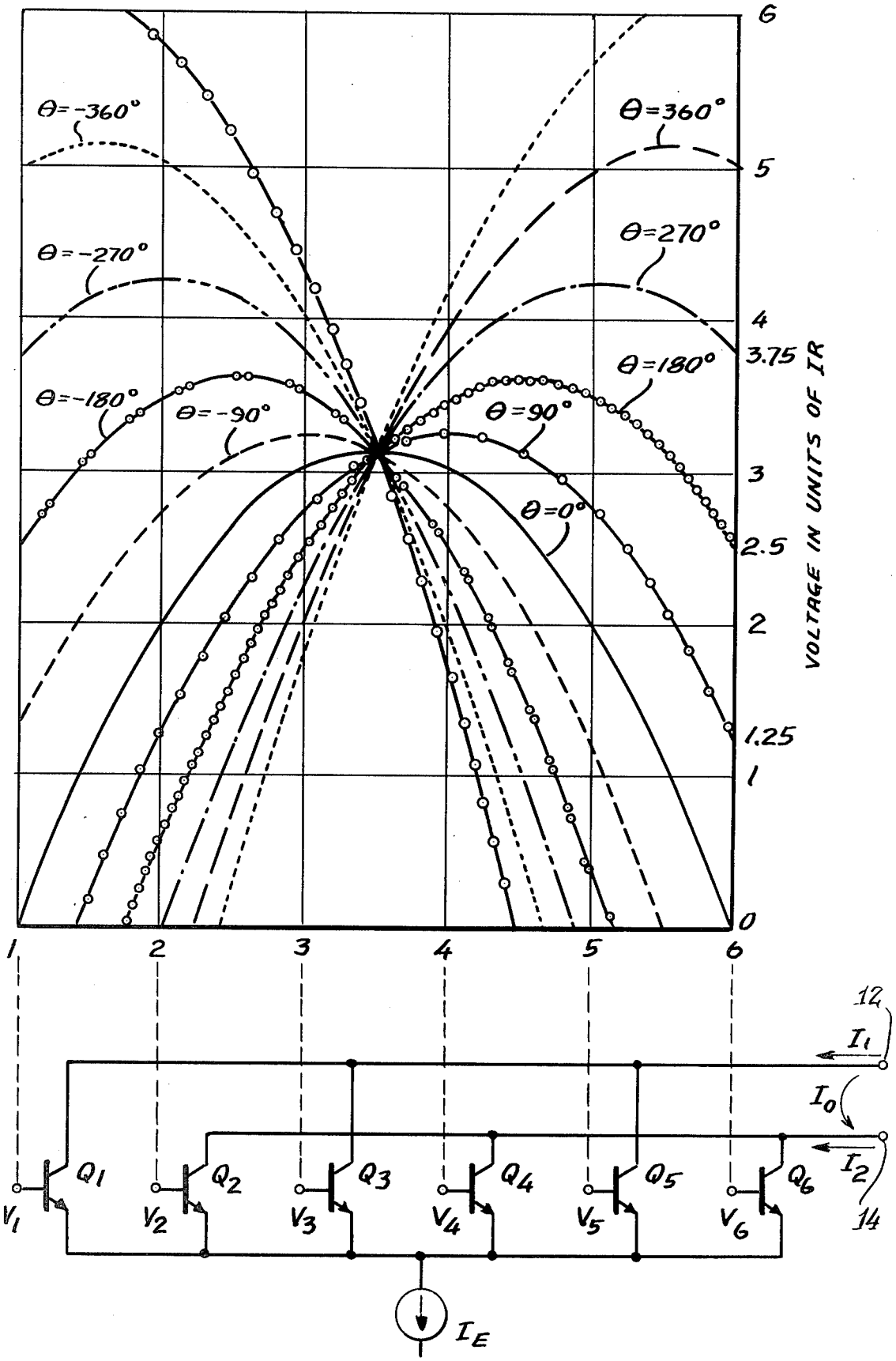
FIG. 1 is a composite circuit diagram and graph depicting voltage distribution patterns for the bases of a set of transistors.

For angle inputs different from zero, it will be seen from the graph of FIG. 1 that the overall voltage distribution pattern is asymmetrical, with more transistors on one side of the peak than on the other. Thus, it is necessary to consider all of the transistor base voltages to determine the effect of such asymmetry on the net differential output current.

In a practical version of the FIG. 3 circuit (to be described hereinbelow), an angle input signal $\theta=180°$ will cause the bases of Q3 and Q6 to be 75 mV lower in potential than those of Q4 and Q5. With such a circuit at 300° K., Q3 and Q6 will conduct about 1/18 the current of Q4 and Q5. The base of Q2 will be 225 mV lower, and it will conduct only 1/6000th of the current of Q4 and Q5. Q1 will be completely cut off.

In such a situation, less than 0.008% of $I_E$ is lost to Q2, and the rest divides equally into the pairs Q3/Q6 and Q4/Q5, so that $I_o$ will be to all practical purposes zero. Thus it will be apparent that the asymmetry for an angle input of 180° does not have a significant effect. In general, it will be found that such asymmetry has no significant effect on the net output signal.

With an angle input of $\theta=270°$, the voltage peak appears at vertical line 5, corresponding to Q5, so there will be another peak in the output current $I_o$, as there was for $\theta=90°$. However, the collector of Q5 is connected to the upper output terminal 12, so that the output current has a sign opposite to that of the peak occurring at $\theta=90°$. At $\theta=360°$, Q5 and Q6 conduct equally, producing another null in the output current $I_o$. Further increase in the input angle causes Q6 gradually to get all of $I_E$.

The general network of FIG. 3, using N transistors, N−1 resistors and N−2 current sources, driven at either end, will produce a differential output current which alternates in sign for an interval of (N−1)IR in input voltage, and crosses the zero axis N−1 times.

Figure 4:
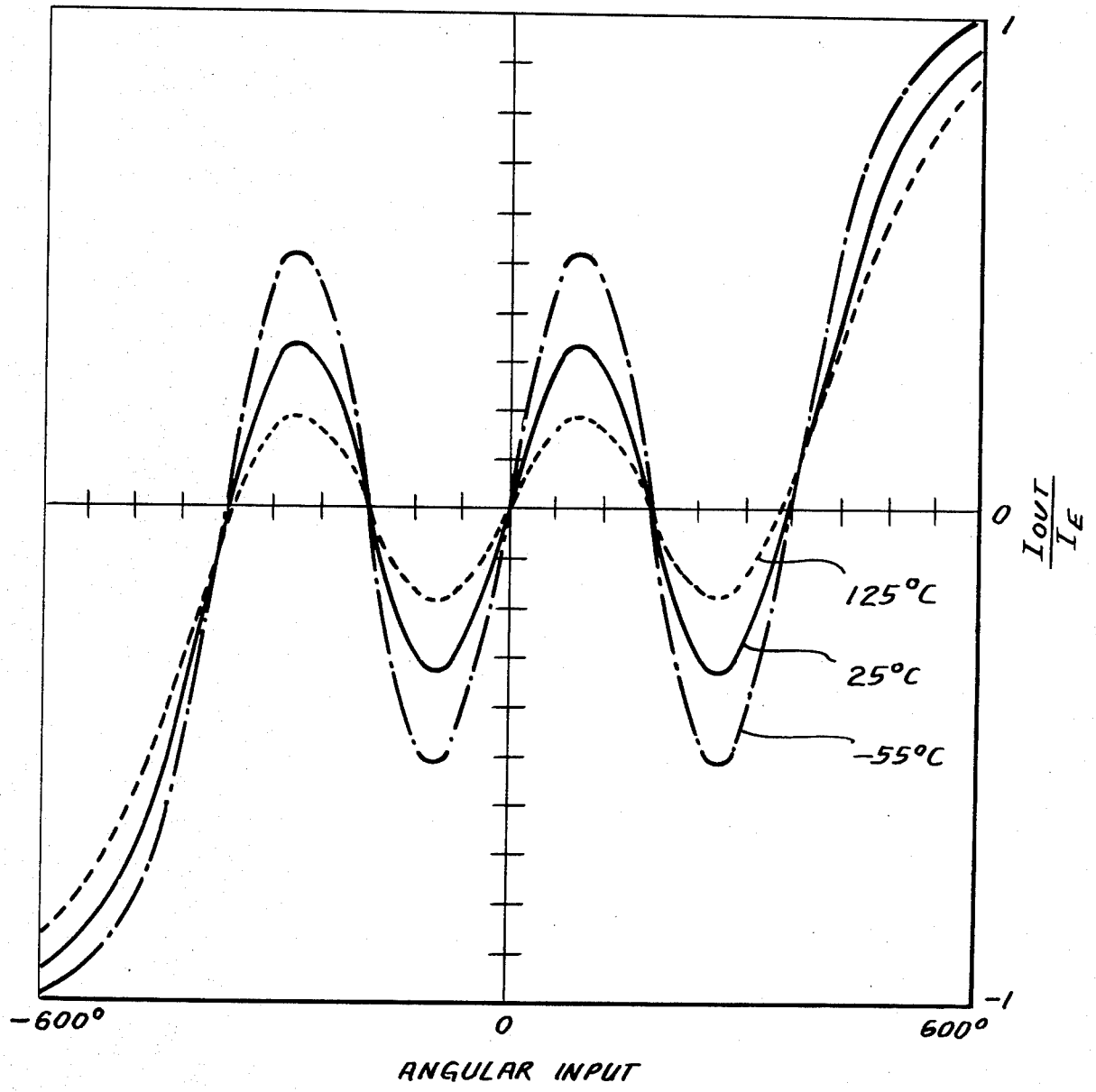
FIG. 4 is a computer-generated plot of the differential output of the circuit of FIG. 3 for temperatures of −55° C., 25° C., and 125° C.

The output current $I_o$ is given by the expression $I_o=-CI_E \sin(\theta_1-\theta_2)$, where C is a temperature dependent factor determined by the network design. This current normally will be converted by the feedback resistance $R_F$ of a high-gain output amplifier to $V_o=CI_ER_F \sin(\theta_1-\theta_2)$. FIG. 4 is a computer-generated plot of the differential output, where the three curves correspond to different temperatures: −55° C., 25° C., and 125° C. The strong temperature dependence is a direct result of the fact that the transistor currents are a function of the thermal voltage kT/q. This is because the transfer characteristic for a conventional differential amplifier of a long-tailed-pair of transistors operating with a common emitter supply $I_E$ is:

$$I_{out}=I_E \tanh E_B/2V_T$$

where $E_B$ is the differential base voltage $V_T$ is the thermal voltage kT/q

The temperature dependence of the output current can if desired be compensated for in various ways, using techniques available in the art. An alternative and superior way to avoid temperature dependence is disclosed in copending application Ser. No. 344,544, filed by the present inventor on Feb. 1, 1982.

It can be seen from FIG. 4 that the first zero occurs at ±180°, corresponding to a control input of ±2.5IR (which in the practical version referred to above was equal to ±187.5 mV). The scaling is determined by the product of the current I and the interbase resistance R.

The scaling factor IR preferably is optimized for various factors, and advantageously is referred back to a basic reference voltage. In the practical commercial design described herein, the final scaling was set by attenuators at both ends of the base-bias network so as to provide a scale factor of 20 mV/°, corresponding to a reference voltage of 1.8 volts for 90°.

By applying the 90° reference voltage to one input terminal 24, and the angle input signal ($\theta$) to the other input terminal 26, the output will be proportional to sin $(90°-\theta)$, or cos $\theta$. Thus the device is also a cosine-function generator, and the expression "sine-function generator" or "sine(cosine)-function generator" should be so interpreted in considering the scope of the invention.

Optimization of the scaling factor IR involves certain trade-offs. As the bias in the transistor bases becomes stronger for $IR>>kt/q$, the transistors no longer steer the current smoothly from device to device, but rather tend to switch abruptly. Thus the output looks more like a series of square pulses, which would produce serious non-linearity. However, on the plus side, the output current would be much greater, resulting in high efficiency and fewer difficulties in maintaining low noise and drift at the output. Also, the higher base voltages would reduce errors due to $V_{BE}$ mismatches in Q1–Q6.

Going to lower values of IR, the conformance to the exact sine law will improve, up to a point. However, the amplitude rapidly gets smaller, so that beyond a certain point the net advantage may be negative due to errors arising from trying to use a small output in the presence of noise and other interfering conditions such as mismatches. At an optimum value of IR in the commercial design, the output very closely approximates a sine function. A rigorous mathematical analysis shows that for N approaching infinity, and $IR<<kT/q$, the output becomes exactly sinusoidal.

Figure 5:
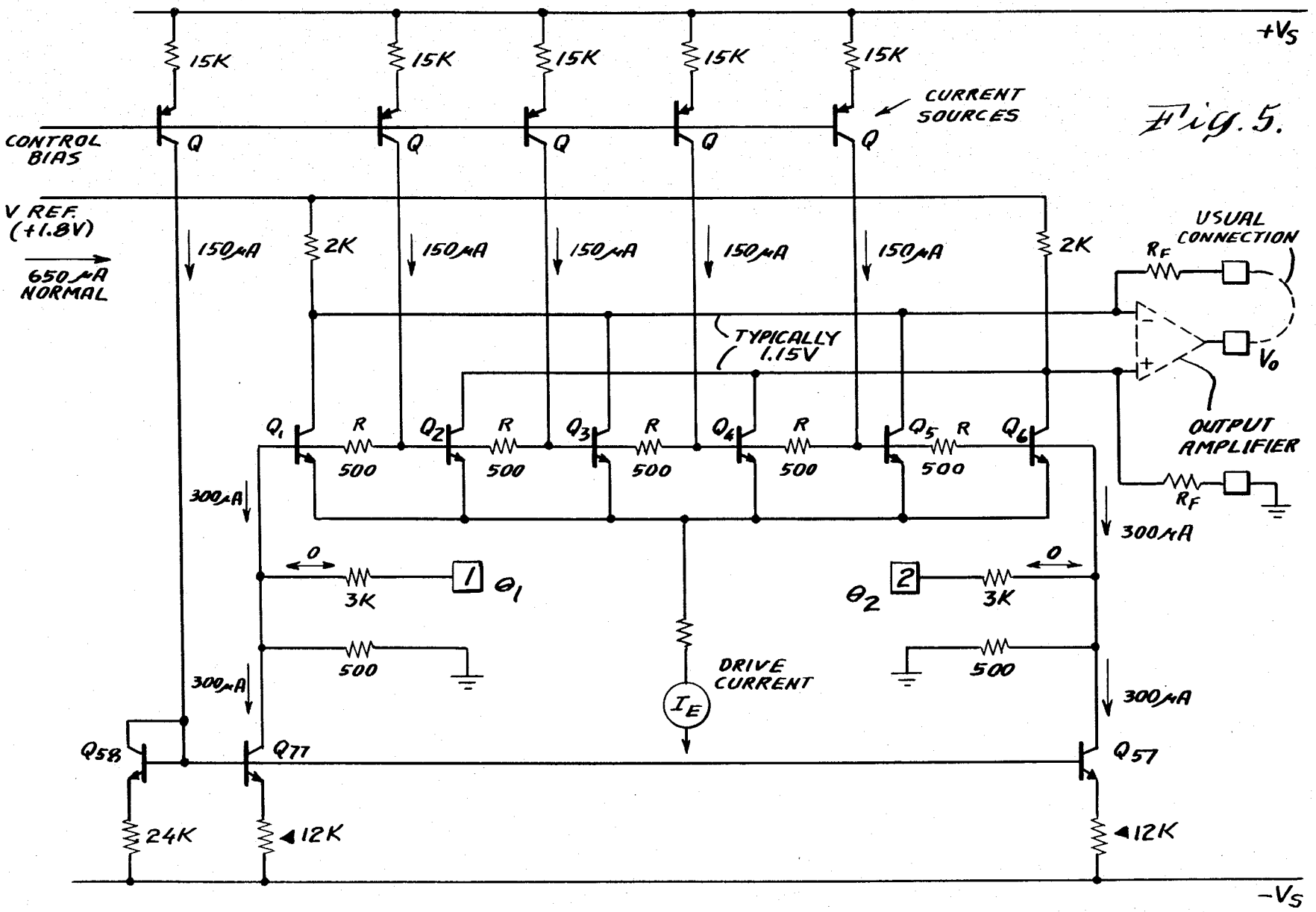
FIG. 5 is a detailed schematic of a sine-function generator in accordance with this invention.

FIG. 5 presents a detailed schematic of one preferred embodiment optimized in accordance with the above discussion as well as for operation over established temperature ranges. The final choice provides an IR product of about 75 mV (actually closer to 76.6 mV, to simplify trimming during fabrication). This is a relatively high value, selected to maintain a reasonable efficiency over temperature, and to minimize problems due to $V_{BE}$ mismatches and thermal gradients. With this choice, the error due to the basic network properties always decreases with increasing temperature, but the efficiency likewise decreases so that noise and offset errors will increasingly contribute to the total error budget referred to output.

Figure 6:
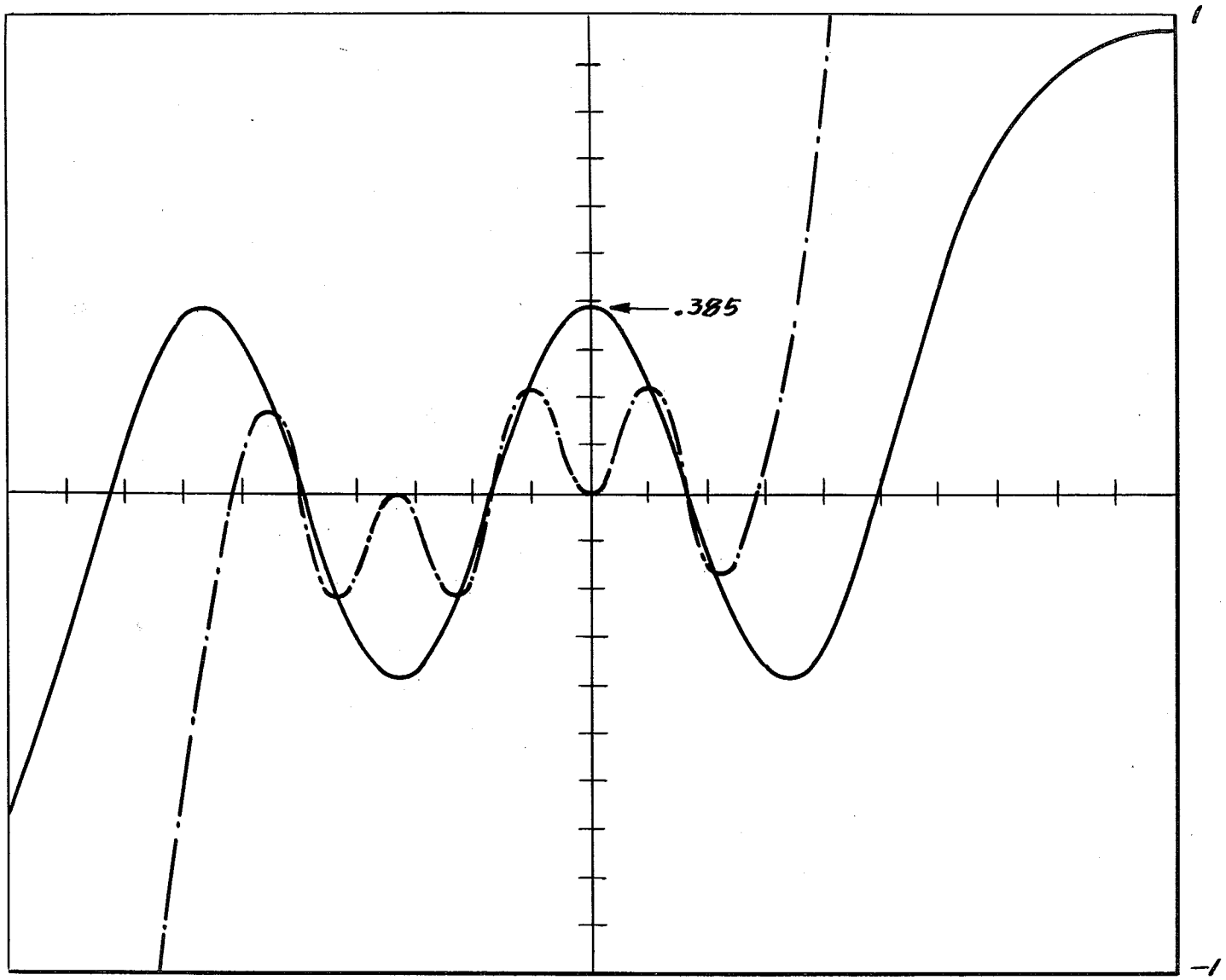
FIG. 6 is a plot of the function generated by one particular implementation of the six-transistor circuit of FIG. 3, together with the calculated error compared to an exact sinusoid of the same period, amplitude and phase; the error is shown in dotted line with a maximum scale of ±1%.

FIG. 6 shows a plot of the function generated by the six-transistor circuit, together with the calculated error (dotted line, with a peak error of ±1%) compared to an exact sinusoid of the same period, amplitude and phase. These results are for an ideal simulated circuit. The simulation technique used resulted in an inconsequential 90° shift in the presented curves. The amplitude peak is 0.385, and the maximum error is 0.21% within a ±180° range.

Figure 7:
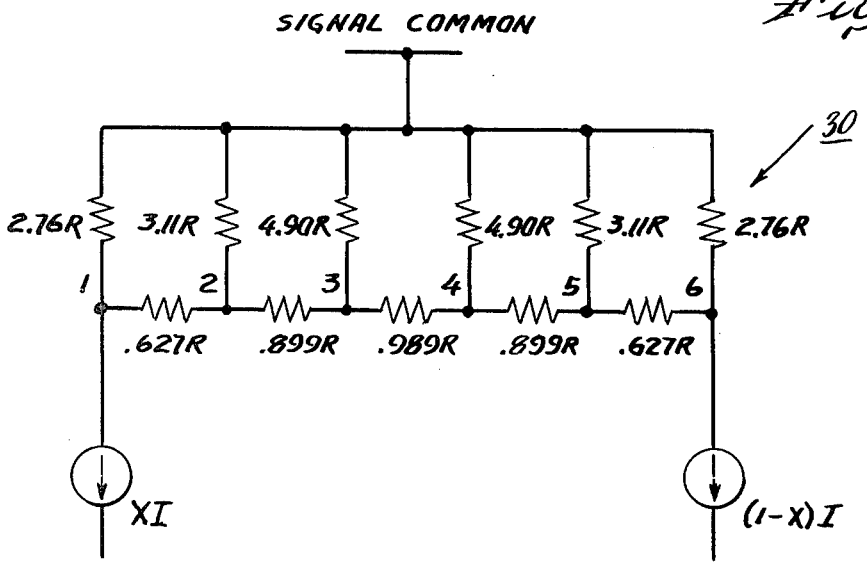
FIG. 7 is a schematic diagram showing an alternative base-bias network for the six-transistor circuit of FIG. 3.

FIG. 7 shows another base-bias network 30 to produce a parabolic voltage distribution for the six-transistor circuit of FIG. 1. (Such a network also is described in the above-mentioned article in the IEEE Journal of Solid-State Circuits.) This network is in the form of a specially designed ladder which avoids the use of current sources for the internal nodes, employing shunt resistors instead. The ends of the network are driven by respective complementary current sources XI and (1−X) I having a constant sum I and a "modulation index" of X. Consider first that X=I, so that all of the driving current is applied to node 1 of the network. Under these conditions, node 1 will be the most negative. The resistive elements have values selected such that the voltages at nodes 1 through 6 increase in a parabolic sequence, with node 6 being the most positive.

Since the network 30 is symmetrical, a mirror-image result will arise for X=0. For any value of X, the net voltage distribution for the bases can be simply calculated by superposition, and it will always be parabolic in form. As with the network 20 previously described, a voltage peak is made to shift laterally across the nodes as X varies from 0 to 1.

Figure 8:
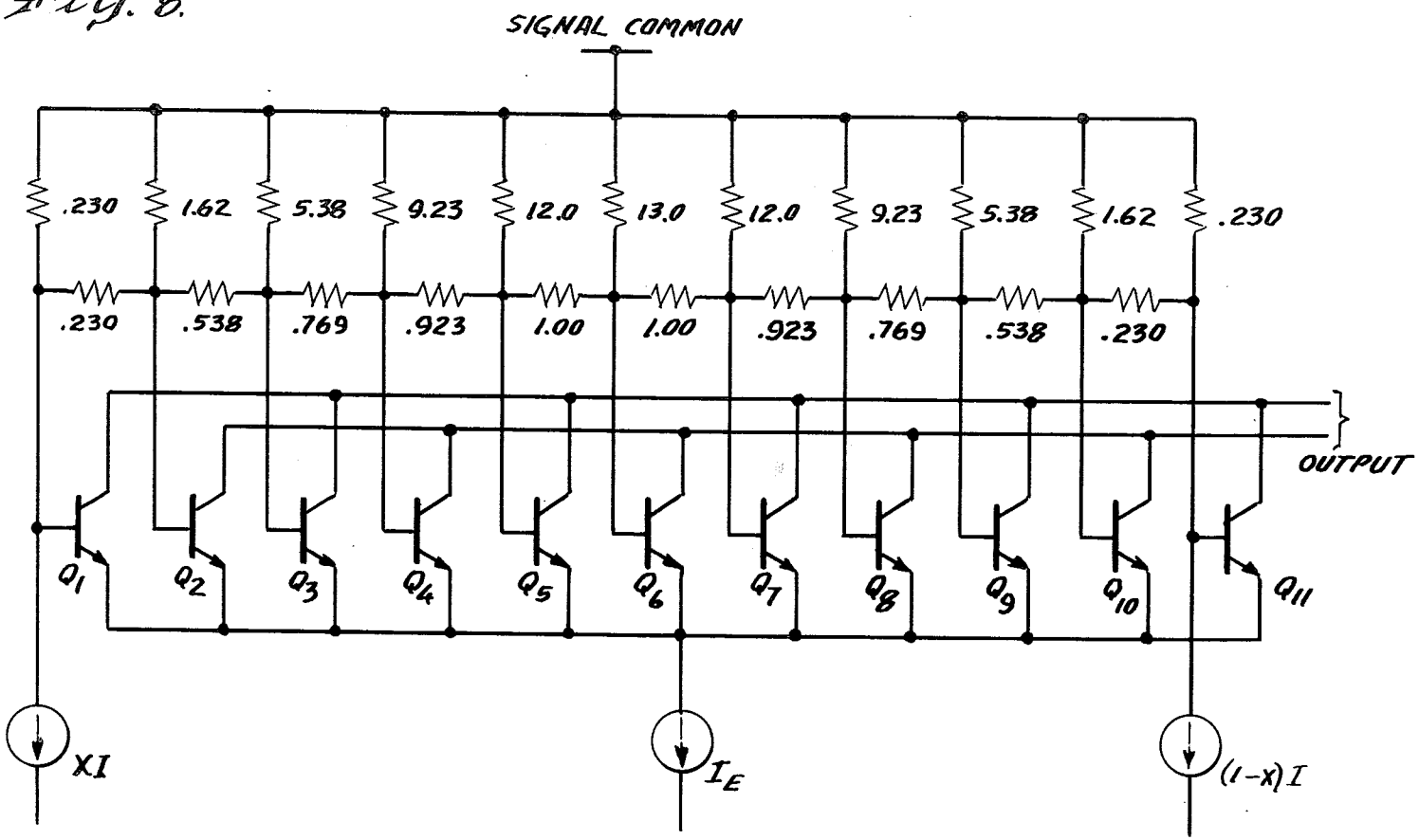
FIG. 8 is a schematic diagram showing an eleven-transistor sine-shaping circuit using a base-bias network similar to that of FIG. 7.

An important characteristic of this type of network is that the position of the voltage peak along the nodal "line" is dependent only on a dimensionless factor, X. The magnitude of the voltages, however, is still determined by the product of the current I and the normalizing resistance R. The total angular range (for $0<X<1$) of a sine-shaping network using the network 30 can be shown to be $\pm(N-1)90°$, or ±450° for n=6 (as shown). FIG. 8 shows an eleven-transistor circuit having a total angular range of 1600°.

One advantage of this network configuration is that the IR product can be made proportional to absolute temperature (PTAT), so that the important factor IRq/kT can be made independent of temperature. In this way distortion can be held at an ideal minimum value, and the amplitude of the function will be independent of temperature.

Figure 9:
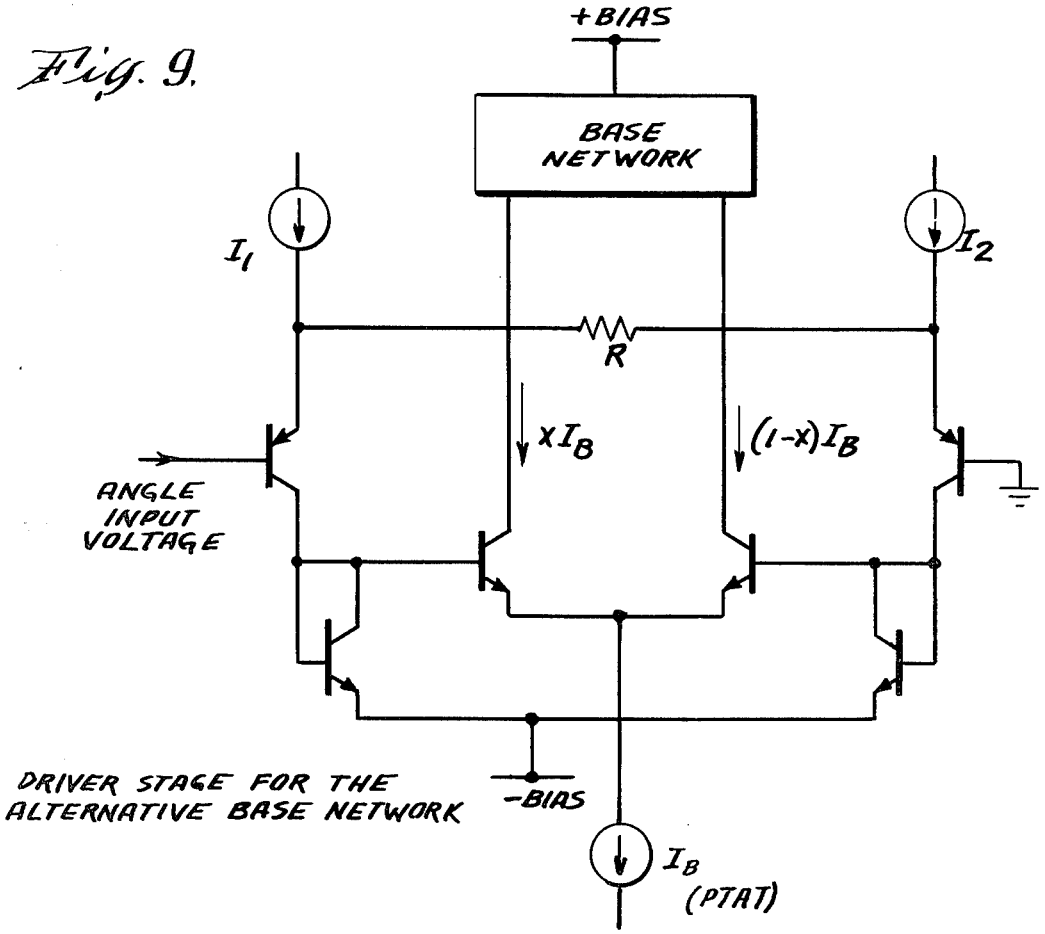
FIG. 9 is a schematic diagram showing a driver stage for the base-bias networks of FIGS. 7 and 8.

FIG. 9 shows one way of performing the voltage-to-modulation-index conversion for the arrangements of FIG. 7 and 8.

Although preferred embodiments of the present invention have been described herein in detail, it is desired to emphasize that this is for the purpose of illustrating the principles of the invention, and should not necessarily be construed as limiting of the invention since it is apparent that those skilled in this art can make many modified arrangements of the invention without departing from the true scope thereof.

I claim:

1. A sine (cosine)-function generator comprising:

first and second output terminals;

a set of transistors;

first circuit means connecting the outputs of said transistors to said first and second output terminals in alternating antiphase to develop an output current;

a base bias network comprising resistance means having a sequence of separate nodes;

supply means connected to said bias network to develop voltages at said nodes according to a predetermined multi-valued distribution pattern having a peak located along a line representing the nodal sequence;

second circuit means connecting said nodal voltages to the bases of said transistors respectively to control the flow of currents therethrough in accordance with the nodal voltages; and input means for said base bias network to receive an input signal representing an input angle, said input signal controlling the positioning of said peak along said nodal line to set the magnitude of said output current to be linearly proportional to the sine (cosine) of said input angle.

2. Apparatus as claimed in claim 1, wherein said base bias network produces a parabolic distribution pattern.

3. Apparatus as claimed in claim 2, wherein said network comprises a set of series-connected resistors with the interconnections therebetween serving as said nodes.

4. Apparatus as claimed in claim 3, wherein said supply means comprises a plurality of current sources connected to said nodes, respectively.

5. Apparatus as claimed in claim 4, wherein said input means comprises means to apply to the end points of said resistors a voltage which is proportional to the magnitude of the input angle.

6. Apparatus as claimed in claim 1, wherein said transistors are identical:

the collectors of said transistors being connected to said first and second output terminals in alternating antiphase.

7. Apparatus as claimed in claim 6, wherein said resistors are of equal value.

8. Apparatus as claimed in claim 7, wherein said current sources produce equal currents.

9. Apparatus as claimed in claim 1, wherein said base bias network comprises a ladder with series and shunt resistors.

10. Apparatus as claimed in claim 9, wherein said ladder is driven at its ends by respective current sources controlled by said input signal.

11. Apparatus as claimed in claim 10, wherein said current sources produce complementary currents.

12. Apparatus as claimed in claim 11, wherein one of said current sources produces a current XI, and the other produces a current $(1-X)I$, where X is a modulation index proportional to said input signal.

13. Apparatus as claimed in claim 9, wherein said ladder network produces nodal voltages having a parabolic sequence.

14. The method of generating a signal proportional to the sine (cosine) of an angle, comprising:

activating a resistive network to develop on a series of nodal points a set of voltages according to a predetermined pattern having a peak located along a line representing the sequence of nodal points;

controlling the bases of a set of transistors in accordance with said nodal voltages respectively;

directing the currents of said transistors to a pair of output terminals in alternating antiphase; and altering said predetermined pattern of nodal voltages in accordance with an input angle signal to shift said peak along the sequence of bases of said transistors.

15. The method of claim 14, wherein said predetermined pattern corresponds to a parabolic function.

16. The method of claim 14, wherein said angle input signal is a differential signal, whereby an offset signal can be applied to one input side as a constant voltage corresponding to a predetermined fixed angle.

17. The method of claim 16, wherein said fixed offset signal corresponds to an angle of 90°.

18. The method of claim 14, wherein the collectors of said transistors are connected to said output terminals in alternating antiphase.

19. The method of claim 18, including the step of supplying the emitters of all of said transistors from a common current source.

20. The method of claim 14, wherein said input angle signal shifts said peak linearly in proportion to the magnitude of the input angle.

* * * * *